United States Patent [19]

Tsurubuchi et al.

[11] Patent Number: 4,884,110

[45] Date of Patent: Nov. 28, 1989

[54] SHEET CONVEYANCE APPARATUS

[75] Inventors: Yasuo Tsurubuchi; Shogo Kato, both of Hachioji, Japan

[73] Assignee: Konishiroku Photo Industry Co., Ltd, Tokyo, Japan

[21] Appl. No.: 226,561

[22] Filed: Aug. 1, 1988

Related U.S. Application Data

[63] Continuation of Ser. No. 883,146, Jul. 8, 1986, abandoned.

[30] Foreign Application Priority Data

| | | | |
|---|---|---|---|
| Jul. 9, 1985 | [JP] | Japan | 60-150571 |
| Jul. 9, 1985 | [JP] | Japan | 60-150573 |
| Jul. 9, 1985 | [JP] | Japan | 60-150575 |
| Jul. 9, 1985 | [JP] | Japan | 60-150580 |

[51] Int. Cl.[4] ..... G03G 21/00; B65H 5/22

[52] U.S. Cl. ..... 355/319; 271/3.1; 271/122; 271/163; 355/282

[58] Field of Search ..... 355/3 R, 3 SH, 14 SH, 355/23, 24, 26, 318, 319, 320, 321, 282; 271/3.1, 121, 122, 163, 902

[56] References Cited

U.S. PATENT DOCUMENTS

| | | | |
|---|---|---|---|
| 3,556,513 | 1/1971 | Howard | 271/163 X |
| 3,615,129 | 10/1971 | Drawe et al. | 355/26 X |
| 4,080,060 | 3/1978 | Nothmann | 355/23 |
| 4,253,759 | 3/1981 | Rattin | 355/14 SH |
| 4,335,954 | 6/1982 | Phelps | 355/14 SH |
| 4,384,781 | 5/1983 | Takada | 355/3 FU |
| 4,412,734 | 11/1983 | Shibuya et al. | 355/14 SH X |
| 4,464,042 | 8/1984 | Omori et al. | 355/3 SH |
| 4,560,157 | 12/1985 | Hirschberg | 271/3.1 X |
| 4,607,942 | 8/1986 | Koyama et al. | 355/3 SH |
| 4,607,948 | 8/1986 | Naito | 355/24 |
| 4,627,718 | 12/1986 | Wyer | 355/3 SH |
| 4,630,921 | 12/1986 | Watanabe | 355/3 SH |

*Primary Examiner*—Fred L. Braun

*Attorney, Agent, or Firm*—Jordan B. Bierman

[57] ABSTRACT

In a copying machine, a sheet conveyance mechanism which allows an image to be copied on both sides of a sheet of paper. The sheet conveyance mechanism includes an intermediate tray in which the sheet is copied on one side thereof by an image copy section, a friction roller capable of effecting reversible rotation and a double feed preventing roller. In operation, a sheet of paper is conveyed by the friction roller into the intermediate tray in which an image is copied onto one side of the sheet, the sheet is then removed by the friction roller, rotating in the reverse direction and transported back to the intermediate tray in which an image is copied on the second side of the sheet.

22 Claims, 13 Drawing Sheets

FIG. 7
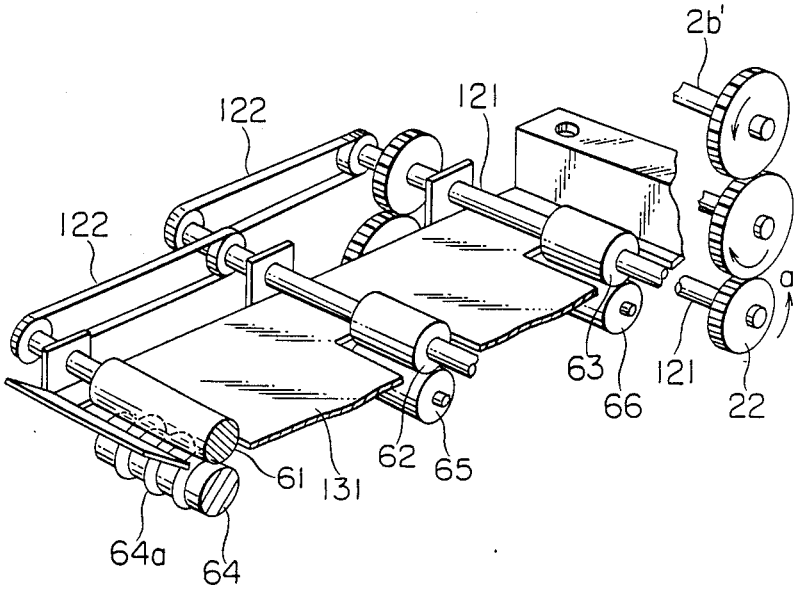
FIG. 8(I)
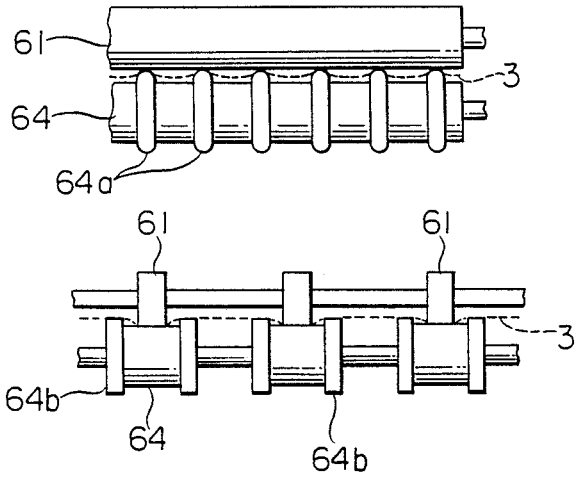
FIG. 8(II)

FIG. 13(III)
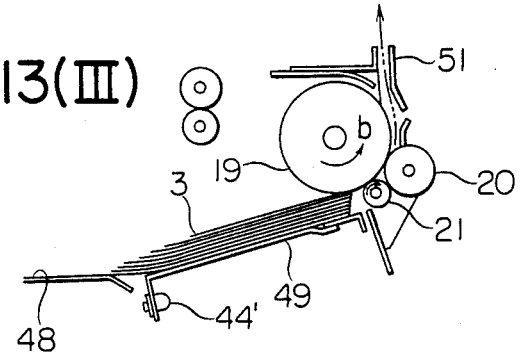

SHEET CONVEYANCE APPARATUS

This application is a continuation of application Ser. No. 883,146, filed July 8, 1986, now abandoned.

BACKGROUND OF THE INVENTION

This invention relates to a sheet conveyance apparatus which may be used in various types of recording equipments, for example, a copier, a printer and the like, (hereinafter referred collectively to as a copying machine), provided with a mechanism in which one-side processed sheets are stored intermediately and from which the one-side processed sheets are conveyed further, and more particularly relates to the improvements relating to a sheet coveyance apparatus which is effective in the case that an image is processed on the both sides of a sheet.

In a copying machine, it is desirable that not only one-side copying operations but also both-side copying operations may be applied to copy sheets. Accordingly, various techniques have so far been proposed to try to materialize the above-mentioned desire. Namely, a set of duplex original documents may be copied on only one side of every copy sheet and also on the both sides thereof by regularly circulating the original document in such a manner, for example, that a set of original document papers to be copied (hereinafter referred simply to as the original), which are printed in the order of pagenation on the both sides of each papers, are fed in the order of the pagenation from a tray onto an original platen through an automatic original feeding means, and is then exposed to light. Every one side of the original is exposed one after another first, and after completing a series of the one-side copying operations, the original for making copy of the other side are fed onto the original platen and are then made them up side down and restored onto the tray again. Besides the above, an original printed on only one side thereof may be copied on the both sides of copy sheets and, it is the matter of course that a copy can be made on only one sides of copy sheets. Such ân apparatus as mentioned above can be served as those not only for conveying an original but also for conveying copy sheets. It is further advantageous to use such a document recirculation means applicable to a copying machine as disclosed in Japanese Patent Publication Open to Public Inspection (hereinafter referred to as Japanese Patent O.P.I. Publication) No. 22141/1985.

Now, a conveyance apparatus used for copying an image both side of copy sheets will be described below:

A toner image formed on a photoreceptor drum in a copying section by an optical means is transferred onto a copy sheet fed from a sheet feed tray and is then fixed on it by an image fixing means. Thereafter, when making a copy on only one side of a copy sheet, the copied sheet is delivered and is then collected onto a delivery tray which is normally attached onto a copying machine and is operable from the outside of the machine, in the meantime, when making duplex copies, one-side copied sheets are piled up in an intermediate tray provided inside the machine through a conveyance section.

The one-side copied sheets once piled up there enter into the copying section through a sheet feed conveyor means again, so that a copy may be made on the reverse side of the one side copied sheet and may then be collected onto the delivery tray attached onto the machine through the fixing means.

As for such an apparatus as described above, those described in Japanese Patent O.P.I. Publication No. 82247/1984 are known. There are such a method as described above, in which a series of one-side copies are made altogether first and, after the completion of the one-side copies, a series of the other side copies are then made altogether, and another method in which a one-side copy and the other side copy are made alternatively one after another. There are also some instances where a desired number of both-side copies and one-side copies are made so as to compile a required number.

The techniques mentioned in the last instances are described in Japanese Patent O.P.I. Publication No. 82247/1984, for example.

The technique described in Japanese Patent O.P.I. Publication No. 22141/1985 is that a given number of original document papers such as original manuscripts or copied original papers which are to be copied are stored in a document tray and supplied therefrom one after another so that the every one-side thereof may be copied, and then they are reversed or not reversed to be returned to the document tray again and the both-side copies (or the one-side copies) are finally made, and the original documents or the copied original are restored altogether in the document tray. In this technique, it is not necessary to provide any intermediate tray inbetween. And, Japanese Patent O.P.I. Publication No. 82247/1984 describes a conveyor means used for copy sheets that is one of such a type as those provided separately with a sheet feed tray, a delivery tray and an intermediate tray for reversing and storing copy sheets therebetween.

The former is mainly used for feeding original documents and is made relatively compact. On the other hand, the latter, the above-mentioned conveyor means used for copy sheets, has been inconvenient from the viewpoints of the maintenance and usage, such as that it is apt to take up much room and particularly the conveyor mechanism thereof for conveying the copied sheets into the intermediate tray (hereinafter called a stack tray) and the mechanism for reversing the side of the copied sheets and refeeding them from the stack tray to the copying section have been provided separately so as to become large in size of the apparatus as well as the mechanisms have been complicated and the installation space for the copying machine has accordingly been increased.

Besides the above-mentioned inconveniences, in this type of conveyor means for copy sheets, there have been the other problems such as that, because the path for storing the copy sheets copied one side thereof into a stack tray and the path for refeeding them from the stack tray into the copying section have been provided to the different positions from each other, it has been necessary not only to take much room for providing each of the paths but also to make forward a stopper for supporting the trailing edge of the copy sheets (that is the leading edge thereof in the case of storing them) so as to move the copy sheets upto the position where a refeeding roller is provided, therefore, the constitution of the means has been complicated and many troubles are apt to take place.

The refeeding mechanisms for refeeding the copy sheets from a stack tray into a copying section and for making the both-side copies have so far been provided with a friction wheel as the refeeding roller for feeding the copy sheets and a lifting plate for lifting up the copy sheets stored in the stack tray so as to bring the copy sheets into contact with the friction wheel, wherein the timing for starting the friction wheel in rotation and the timing for starting the lifting plate in lifting motion have been the same. Therefore, at the point of time when bringing the copy sheets into contact with the friction wheel, the friction wheel has already been rotating and, resultantly, the copy sheets had been fed out before the copy sheets have been brought into contact properly with the friction wheel so as to cause a sheet damage.

In the above-mentioned stack tray, it is desired that the copy sheets fed thereinto through a conveyor means are to be so stored therein as to be in such a state that they may readily be fed again. For this purpose, a copy sheet leading edge stopper member and copy sheet width regulating plates have so far been provided to the floor member of the stack tray and, in addition, a means capable of automatically moving and adjusting the leading edge stopper member and the width regulating plates according to the sizes of copy sheets has also been provided. However, the above-mentioned moving means have respectively been equipped with their own independent driving sources, so that the apparatus has been enlarged in size as well as increased in cost.

Further, because the conventional types of the leading edge stopper members have not been equipped with any locking means at all, such stopper members have been shifted from their prescribed positions by the shocks of the copy sheets thereby stopped, so that there have caused the obstacles to the refeed of the copy sheets.

Still further, as described above, a both-side copying apparatus is generally so constructed that a copy is made on one side of copy sheets in a copying section, and the copy sheets are conveyed to the underneath of the copying section and then stored into a stack tray, thereafter the copy sheets are refed from the stack tray into the copying section so as to be copied on the both-side.

In this type of the apparatuses, however, the copy sheets are curled by the heat in the copying and fixing processes and, resultantly, such copy sheets are unable to pass through a conveying path smoothly and are in such a risk that they may be jammed halfway.

The mechanism for changing conveying path in order to store the copy sheets into the stack tray is necessarily provided with at least a function that the copy sheets are made go on to a sheet delivery tray attached onto the machine. In other words, it is necessary for this mechanism to switch a delivering operation for collecting the copy sheet onto the delivery tray or a reversely conveying operation for storing the copy sheet into the stack tray over from one to the other and, therefore, such mechanisms cannot help being complicated and, accordingly, there has also been such a problem in this type of mechanisms that the frequency of causing sheet jamming troubles is inevitably increased.

SUMMARY OF THE INVENTION

It is a primary object of the invention to solve the defects in the above-mentioned sheet conveyance apparatus.

A sheet conveyance apparatus relating to the invention in which a sheet is stored intermediately in a stack tray upon being printed on one side thereof at a first processing part and is then conveyed again from the stack tray to a second processing part to be printed on reverse side thereof; such sheet conveyance apparatus is characterised in that a mechanism for conveying the sheets for storing to the stack tray can be reversed in rotation thereof and the sheets are thereby conveyed again to the second processing part.

As more preferred embodiment, the invention may provides a sheet conveyance apparatus for copying an image on both side sheets which comprises aforementioned sheet conveyance apparatus and a copying section performing as both the first processing part and the second processing part.

Namely, a sheet conveyance apparatus for copying an image on both side of sheet comprises;

a first feed tray for storing a sheet;

an image copy means for copying and fixing an image information to the sheet;

a delivery tray for collecting the copied sheet thereon;

a first conveying part for feeding the sheet from the first feed tray to the image copy means and then delivering the copied sheet onto the delivery tray;

a path-change means being arranged in the first conveying part between the image copy means and the delivery tray for changing a conveying direction for the copied sheet according to copy pattern orders consisting of a one side copy order and a both side copy order;

a second feed tray as the stack tray for storing the one side copied sheet being changed the conveying direction not to delivery onto the delivery tray by the path-change means in accordance with the both side copy order; and a second conveying part capable of effecting reversible rotation for conveying the one side copied sheet from the path-change means to the second feed tray on one rotation direction and for feeding the one side copied sheet from the second feed tray to the image copy means on reverse rotation direction; so that the one side copied sheet can be copied an image information on the reverse side thereof and then delivered onto the delivery tray.

In the second conveying part, the path for storing the copy sheets copied on one side thereof into the stack tray and the path for refeeding the copy sheets from the stack tray into a copying section are made in common with each other, and an elastic thin plate is provided to the positions adjacent to the common path so as to open the storing path when an incoming sheet is passing therethrough and to close it after the outgoing sheet passed therethrough.

The second conveying part is so constituted that a friction roller is so provided as to be able to rotate in the direction of storing the copy sheet into the stack tray and in the direction of refeeding the copy sheet into a copying section and the friction roller is brought into pressing contact with a double feed prevention roller capable of freely rotating when the friction roller rotates in the direction of storing the copy sheet and incapable of rotating when the friction roller rotates in the direction of refeeding the copy sheet and, further, the lower surface of the friction roller is brought into pressing contact with an auxiliary roller pivotally supported by a freely rotatable lever provided to and extended from the shaft of the double feed prevention roller.

This invention is also constituted that a lifting plate is so provided as to lift up and bring the copy sheet into contact with the friction roller when the copy sheet is refed from the stack tray into the copying section after the copy sheet was stored in the stack tray, so that the friction roller may not be started in rotation until the copy sheet is brought into contact with the friction roller by the lifting operation of the lifting plate.

Further, this invention is so constituted that a leading edge stopper member and a width regulating plates for the copy sheet are provided onto the floor member of the stack tray. both a moving means for the leading edge stopper member and a moving means for the sheet width regulating plates are connected to a common driving source through a switching means, and a locking means is so provided as to lock up a driving gear for moving the leading edge stopper member during the gear is not in operation.

Still further, this invention is so constituted that, with the purpose of smoothly conveying the copy sheets curled by the heat in copying and fixing processes through a conveyance path without any jamming trouble, the conveyance path is provided with a rollers, i.e., a pair of pinch rollers of which the lower roller is preferably a flange roller, which is a cylindrical roller and has a pair of flange on both side thereof, for making the copy sheets into a waveform to give stiffness and for keeping the leading edges thereof horizontal and a rollers, i.e., a pair of pinch rollers of which the lower roller is preferably a flat-faced roller for bending the copy sheets as they are in a natural state; and the invention is also so constituted that, for the purpose of making a single roller serve as a conveyance roller capable of performing the functions of the above-mentioned two pairs of the pinch rollers, a roller is so comprised of the main body thereof and a flange member capable of being detachably attached to the both ends of the main body, so that the roller may readily serve as a flat-faced roller by simply detaching the flange member.

In addition to the above, the invention is so constituted that a sheet delivering section, the conveyance path, the stack tray and the secondary sheet feed means are made compact in size for readily remedying a sheet jamming if it is the case, a movable guide plate capable of guiding the copy sheets is provided as the path-change means between a fixing unit and a sheet delivering unit provided to the downstream side of the fixing unit, so that the movable guide plate together with the sheet delivery unit may be taken out in the direction of delivering the sheets; and, further, this invention is so constituted that, to the underneath of the main body of a copying machine, a conveyance unit provided with a conveyance path through which the copy sheets are conveyed for storing, a sheet storing unit provided with a stack tray into which the copy sheets are stored and a secondary sheet feed unit provided with a friction member capable of rotating in the direction of feeding the copy sheets into the stack tray and in the direction of feeding the copy sheets from the stack tray are separably arranged.

Referring now to a preferred embodiment of the invention illustrated in the drawings attached hereto, the invention will be described below.

BRIEF DESCRIPTION OF THE DRAWINGS

A better understanding of the present invention may be had from the following detailed description when read in connection with the accompanying drawing.

FIG. 7 is a sectional perspective view illustrating of the conveyance rollers and the press rollers.

FIGS. 8(I) and 8(II) are the front views each illustrating the preferred embodiment of the wave-forming rollers, respectively.

DETAILED DESCRIPTION OF THE INVENTION

Figure 1:
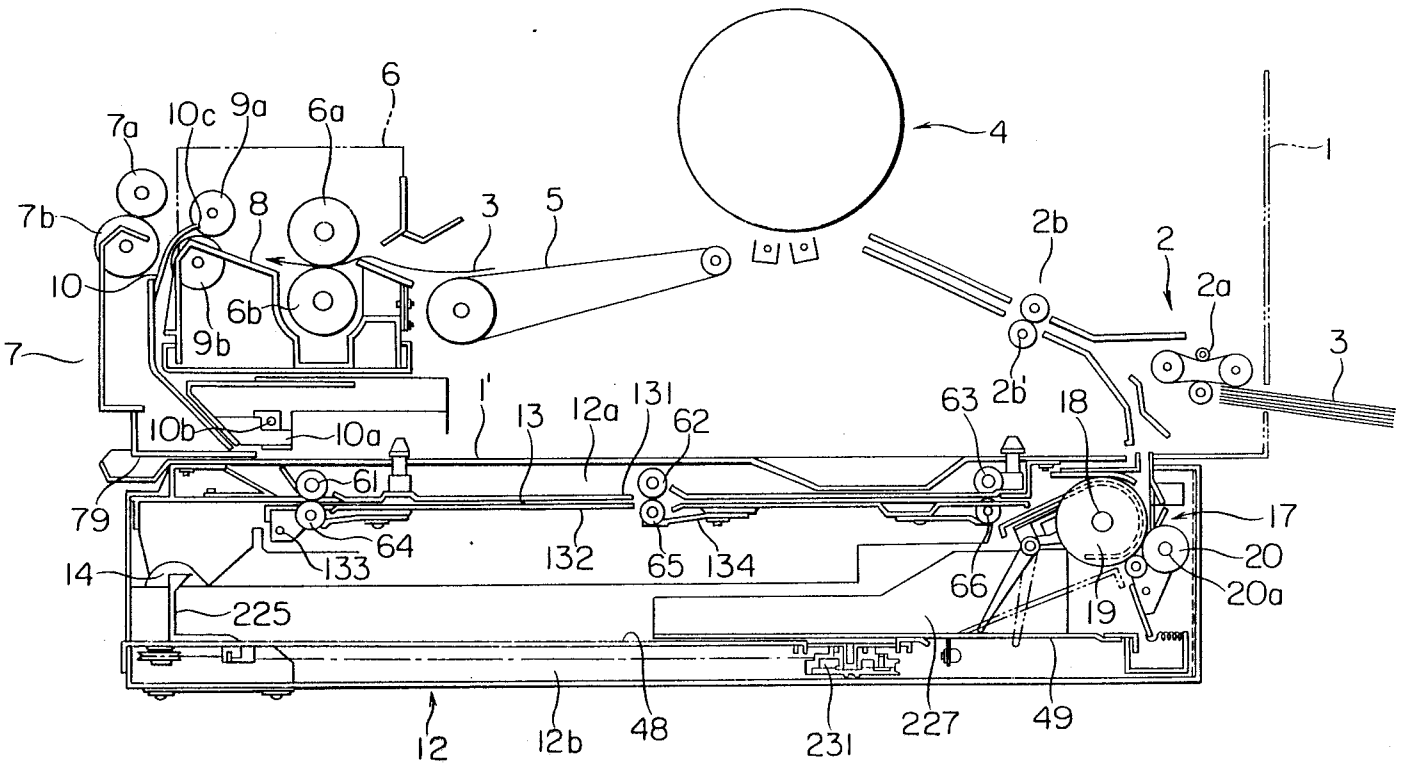
FIG. 1 is a overall sectional view of the preferred embodiment in the present invention.

In FIG. 1, reference numeral I designates the main body of a copying machine; 2 is a primary sheet feed means, which is comprised of a sheet feeder 2*a* whereby copy sheets 3 stored in a cassette as the first feed tray (not shown) are fed out one after another and a relay sheet feeder 2*b* provided to the halfway of a path whereby the copy sheets 3 are led to a copying section 4; 5 is a conveyor belt for conveying the copy sheets 3 copied in the copying section 4; 6 is a image fixing unit provided with fixing rollers 6*a*, 6*b* each for fixing the copied image on the copy sheets 3 conveyed thereto by the conveyor belt 5, a guide member 8 for guiding the copy sheets 3 passed through the fixing rollers 6*a*, 6*b* to the direction of delivering the sheets 3 and conveying rollers 9*a*, 9*b*; and the fixing unit 6 is so arranged as to be taken out to the front side of the main body of the copying machine (i.e., to this side in the drawing), for the purposes of remedying a sheet jamming, and cleaning or replacing the rollers and for the like purposes.

Figure 2I:
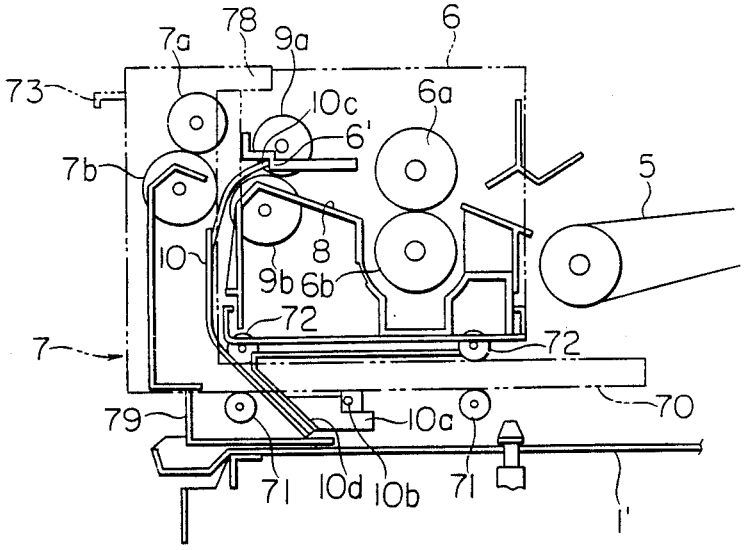
FIGS. 2(I) and 2(II) are sectional views of the sheet delivery unit in which indicate a retracted and drawn out condition respectively.
Figure 2:
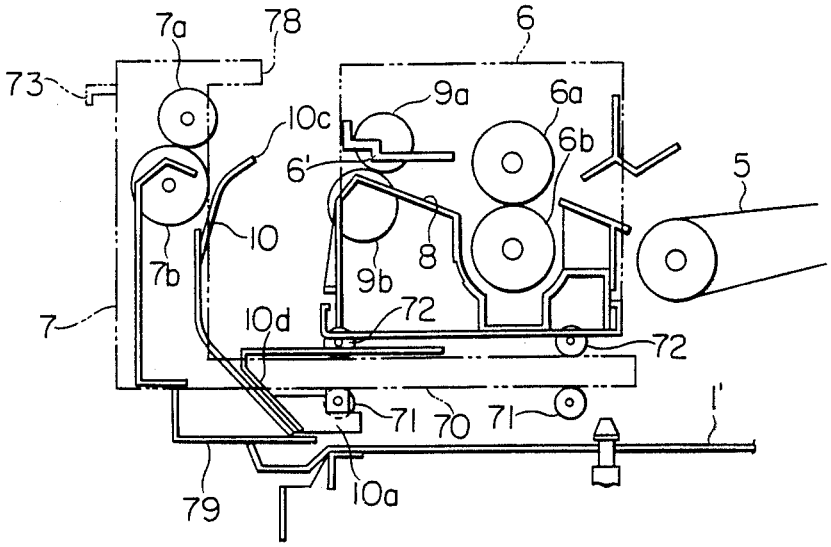

Reference numeral 7 designates a sheet delivery unit provided with sheet delivery rollers 7*a*, 7*b* for delivering the copy sheets 3 already copied; and underneath the both side frames of the sheet delivery unit 7, an extended member 70 extended inward the side frames is slidably supported, as shown in FIG. 2, between a lower pulley 71 horizontally provided. with a given interval, to the inner wall of the main body of the copying machine and a upper pulley 72 which is opposite to the lower pulley 71, and the sheet delivery unit 7 is so arranged as to be taken out from such a retracted position as shown in FIG. 2-(I) toward such a sheets delivering direction as shown in FIG. 2-(II).

Figure 3:
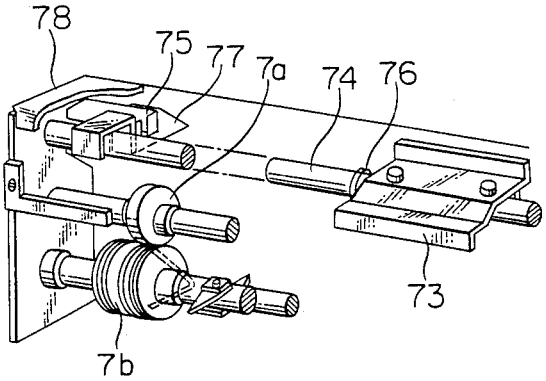
FIG. 3 is a perspective sectional view from the inside of the machine which indicates a handle for pulling out the sheet delivery unit and the portion therearound.

Should there be a jamming trouble in such a section as a sheet path-change mechanism section mentioned later, an image fixing section and the like, such sections are widely exposed when the movable guide plate 10 mentioned later together with the sheet delivery unit 7 are pulled out in the direction of delivering the sheets, so that such a jamming trouble may readily be remedied by the above-mentioned mechanism;

Reference numeral 73 designates a handle for pulling out the sheet delivery unit 7, the handle is extended into the inner side of the sheet delivery unit 7 as in shown FIG. 3 which is perspective sectional view from the inside of the machine.

In FIG. 3, the handle 73 which is inner portion thereof is fixed with a shaft rod 74 which is inserted between the side frames and is rotatably supported.

The shaft rod 74 is fixed with a locking member 77 capable of locking up into a pin positioned at inner side of the fixing unit 6 and is so biased by a spring 76 that the fixing unit 6 is locked up with the sheet delivery unit 7 through the working of the locking member 77 and is prevented to be pulled out transversely to the sheet conveying direction.

When pulling out the sheet delivery unit 7 to the sheet delivering direction by the handle 73, the shaft rod 74 is so rotated interlockingly with the handle 73 that the locking member 77 is released from locking position.

Therefore, the locking member 77 effects the prevention the fixing unit 6 from being pulled out unless the sheet delivery unit 7 is pulled out so that the damage trouble of the moval guide plate 10 can be avoded.

Figure 4:
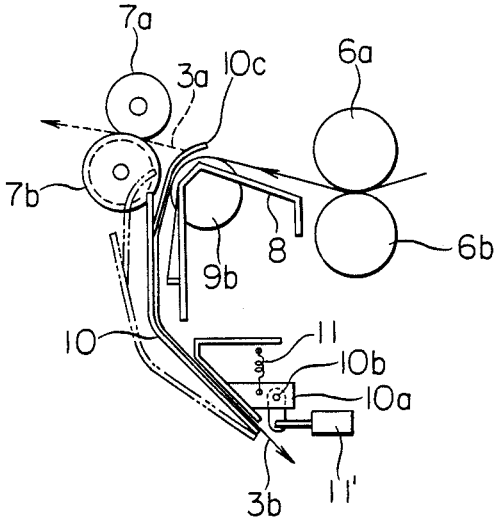
FIG. 4 is a sectional view illustrating the operations of a movable guide plate.

In FIGS. 2 and 4, numeral 10 is a movable guide plate as the path-change means for changing the sheet delivery path 3*a* (indicated by the arrow of dashed line in FIG. 4) for the copy sheets 3 delivered from the fixing unit 6 over to a sheet turning path 3*b* (indicated by the arrow of solid line), wherein the basal end 10*a* thereof is pivotally provided through a shaft 10*b* to the lower frame 79 of the sheet delivery unit 7 extended to the underneath of the fixing unit 6 and the movable end 10*c* of the guide plate 10 is bent to be concave on the side of the fixing unit 6, so as to hit against a part 6' of the fixing unit 6 which is positioned upper than the sheet delivery path 3*a*. When the both side copy is requested, the movable end 10*c* thereof is so arranged as to be pulled by the tension of a spring member 11 to hit against the part 6' of the fixing unit 6, so that the sheets delivered from the fixing unit 6 may be flown through the turning path 3*b* to be introduced into the second conveying part consisting of the later mentioned conveyance section 13 and the latermentioned secondary sheet means 17 from the gap between the movable guide plate 10 and the fixed guide plate 10*d*, and only in the case that the copy sheets 3 are introduced into the sheet delivery rollers 7*a*, 7*b*, the movable guide plate 10 may be escaped as shown by the two-dot chain line in FIG. 4 by the working of a solenoid 11'.

In the invention, the first conveying part may designates the conveying part comprising from the primary sheet feed means 2 to the sheet delivery roller 7*a* and 7*b*.

During one side copy is requested, the copy sheet 3 are copied on one side thereof and then delivered onto the delivery tray through the first conveying part.

Namely, movable guide plate 10 can change the conveying path from the first conveying part to the second conveying part.

In FIG. 1, numeral 12 is a double-separated unit attached to the bottom of the main body 1 of the copying machine, which is comprised of the first unit 12*a* provided with a sheet conveyance path 13 for conveying straight the copy sheets 3 flown along the movable guide plate 10 toward the side of the primary sheet feed means 2 and the second unit 12*b* provided with a stack tray 27 for storing the sheets. The upper plate 131 of the first unit 12*a*, which also serves as the upper surface of the sheet conveyance path 13, is screwed to the lower surface 1' of the main body 1 of the copying machine and, on the other hand, the lower plate 132 thereof, Which also serves as the lower surface of the sheet conveyance path 13, is pivotally provided to the upper plate 131 through a shaft 133.

Figure 5:
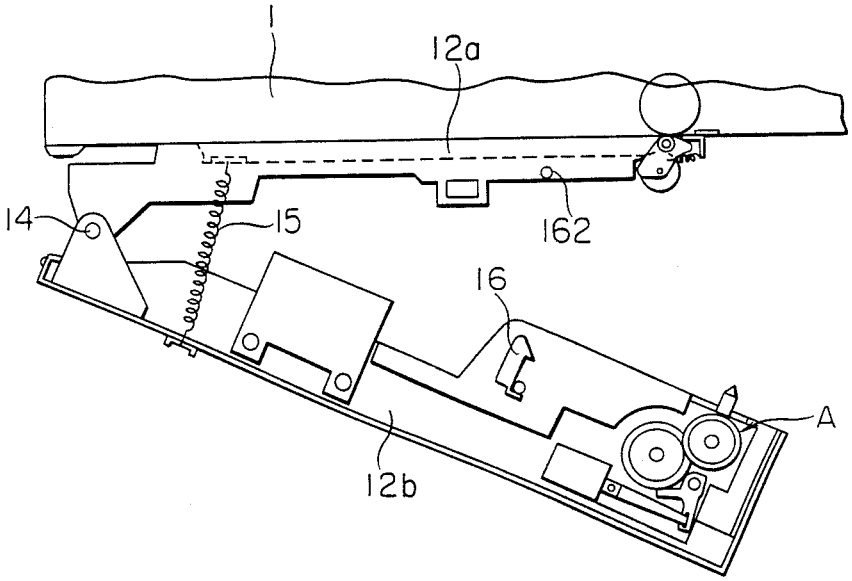
FIG. 5 is a sectional view illustrating the state where the second unit of a double-separated unit is opened.
Figure 6:
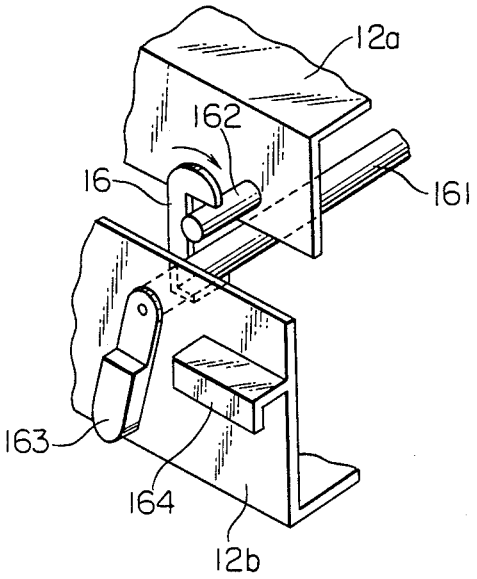
FIG. 6 is a sectional view illustrating the state where the second unit in FIG. 5 is closed.

The above-mentioned second unit 12*b* is so connected to the first unit 12*a* through a hinge 14 as to be opened as shown in FIG. 5. Numeral 15 is a spring member for keeping second unit 12*b* in the opened position and is stretched closer to the hinge 14 between the first unit 12*a* and the second unit 12*b*. 16 is a locking member for keeping the second unit 12*b* in the closed position and is fixed to the shaft 161 inserted between the side frames of the second unit 12*b* as shown in FIG. 6 and is also rotatably biased in the direction of the arrow by the working of a spring member (not shown) so as to be able to lock into a pin 162 protruded from the inner surfaces of the side frames of the first unit 12*a*. 163 is an operating lever fixed to the outer end of the shaft 161; and 164 is a handle provided to the neighborhood of the operating lever 163. Should there be caused a copy sheet jamming in the conveyance path 13, for example, by the aid of the above-mentioned mechanism, the locking member 16 having been keeping the second unit 12*b* in the closed position is disengaged from the pin 162 protruded toward the inner surfaces of the side frames of the first unit 12*a* and the second unit 12*b* is thereby opened around the hinge member 14, by rotating the operating lever 163 counterclockwise with holding the handle 164 provided to the second unit 12*b*, and this opening is opened adequately by the spring member 15 so as to readily remedy the copy sheet jamming trouble. If the second unit 12*b* is to be closed after completing a required work, only thing to be done is to lift up the handle 164, so that the second unit 12*b* is coupled to the first unit 12*a* through the locking member 16 and is then kept in the closed position. The second unit 12*b* may be lifted up lightly by the restoring force of the spring member 15.

Figure 9:
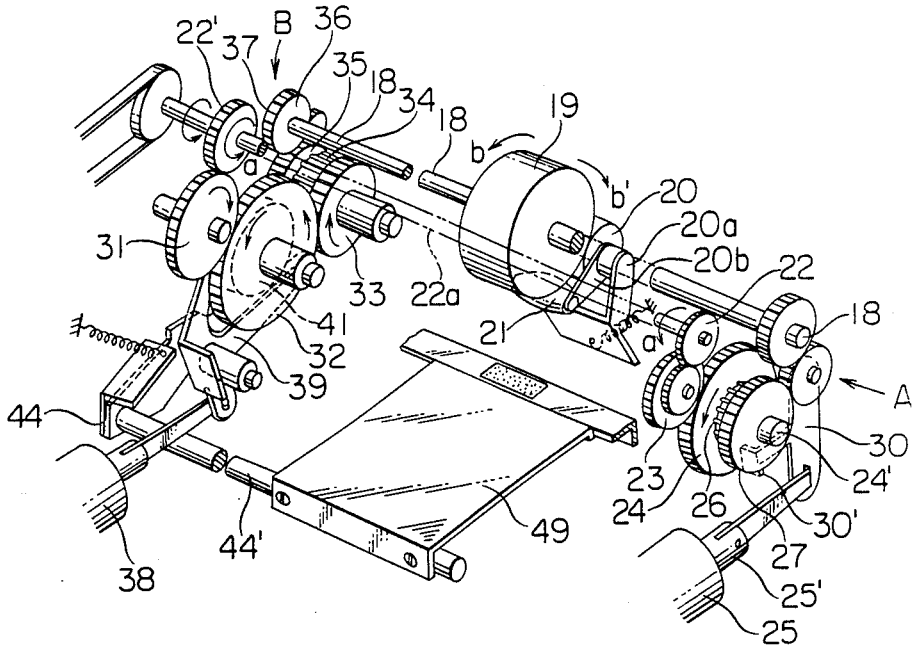
FIG. 9 is a perspective view illustrating the regularly and reversely rotating mechanism of the friction member of the secondary paper feed means.

In FIG. 1, numerals 61, 62 and 63 are pivotally supported conveyor rollers provided to the upper plate 131 serving as the upper surface of the conveyance path 13 so as to expose a part thereof to the inside of the conveyance path and are arranged respectively at the upper stream, the mid stream and the down stream in order in the copy sheet conveying direction. Among these rollers, as shown in FIGS. 1, 7 and 9, the conveyance roller 63 arranged at the downstream side is coaxially fixed to the shaft 221 of the driving gear 22 being rotated in the direction of the arrow a in connection with the driving shaft 2b' of the relay sheet feeder 2b of the primary sheet feed means 2. The conveyor roller 63 at the downstream side is so linked as to be rotated together with the conveyor roller 62 at the midstream side and the conveyor roller 62 at the midstream side is similarly linked with the conveyor roller 61 at the upperstream side, respectively, by an endless belt or rope 122. The conveyor rollers 61, 62 and 63 are brought into pressing contact, respectively, with press rollers 64, 65 and 66 each of which is pivotally provided onto and biased upward by the tip of spring member 134 whose basal end is fixed to the lower plate 132, so that the copy sheets 3 may be conveyed on such manner as sandwich between both rollers.

As shown in FIG. 8, the rollers each capable of making the copy sheets 3 into a waveform are used for at least conveyor roller 61 at the upperstream side out of the above-mentioned conveyor rollers 61, 62 and 63, and press roller 64. The typical examples of the above-mentioned rollers are shown in FIGS. 8-I and 8-II. In such a case as shown in FIG. 8-I, there are used a flat-faced roller as conveyor roller 61 and a roller having a plurality of ring-like protrusions 64a juxtaposed with a given interval in the axial direction onto the circumferential surface of the main body of the roller as press roller 64, respectively. On the other hand, in such a case as shown in FIG. 8-II, there are used a plurality of small and short sized rollers arranged to the shaft thereof as conveyor rollers 61 and a plurality of small and short sized flanged rollers arranged to the shaft thereof as press rollers 64b. The copy sheets 3 thereby conveyed are to be waveformed as shown by the dashed lines in the drawings.

Provided that the copy sheets 3 are flown down along movable guide plate 10 upon fixing, the copy sheets 3 are sandwiched between conveyance roller 61 at the upperstream side of conveyance path 13 of the aforementioned first unit and press roller 64 coming into pressing contact with the roller 61, and are then conveyed by them. The rollers each capable of making copy sheets 3 into a waveform are used for the conveyance roller 61 and the press roller 64 each provided at the upperstream side, as described above, therefore, the copy sheets 3 are made into the waveform and to be more stiff, so that the conveyability in conveyance path 13 can be improved.

Figure 10:
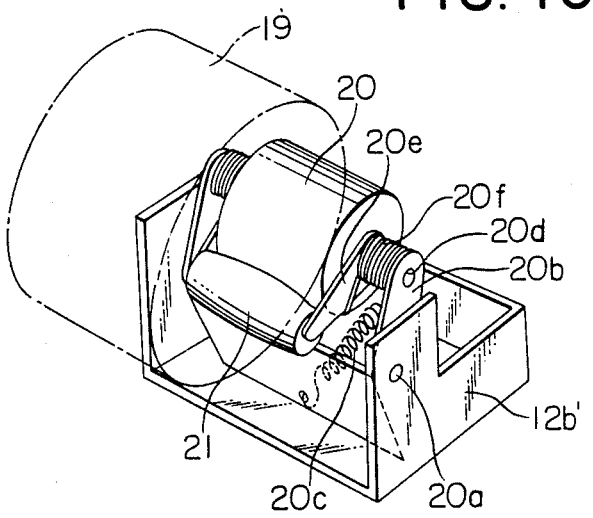
FIG. 10 is a perspective view illustrating the arrangement of the double feed prevention roller and the auxilialy roller.

In FIGS. 1, 9 and 10, numeral 17 is a secondary sheet feed means provided at the forward side in the direction of sheet conveyance in the above-mentioned conveyance Section 13 and is provided with a friction wheel 19 which is fixed to the center portion of the shaft 18 inserted between the side frames of the second unit 12b of the double-side unit 12, a double-feed prevention roller 20 which is pivotally supported by a rotatable arm 20b around a pin 20a attached to a fixture member 12b' stood from the bottom of the second unit 12b and is brought into pressing contact with the friction wheel 19 from the outer surface thereof by the working of spring member 20c, and an auxiliary roller 21 which is pivotally supported by the tip of lever 20e freely connected to the shaft 20d of the double-feed prevention roller 20 and is also brought into pressing contact with the friction wheel 19 from the lower surface thereof by the working of a spring member 20f.

The above-mentioned friction wheel 19 is linked, through gear train A provided to one end of shaft 18 and gear train B provided to the other end thereof, with gear 22 being rotated in the direction of the arrow a as the driving source by linking with the driving shaft 2b' of the relay sheet feeder 2b of the primary sheet feed means 2, so that the friction wheel 19 may be rotated regularly and reversely (i.e., in the directions of the arrows b and b') by a reversing mechanism capable of switching the gear trains A and B over from one to another by the aids of solenoids 25 and 38; namely, the friction wheel 19 may be rotated in the direction of conveying one-side copied sheets for storing into a stack tray 48 in the second unit as shown in FIG. 1 and in the direction of refeeding copy sheets into the copying section from the stack tray 48. A built-in one-way clutch is incorporated into the double-feed prevention roller 20 so as to be freely rotatable during the friction wheel 19 is being rotated in the direction of storing copy sheets (i.e., in the direction of the arrow b') and so as not to be rotatable during the friction wheel 19 is being rotated in the direction of refeeding the copy sheets (i.e., in the direction of the arrow b). Further, the above-mentioned auxiliary roller 21 is to be rotated in the reverse direction against that of the friction wheel 19 by the friction force effected between the auxiliary roller 21 and the friction wheel 19.

Figure 11:
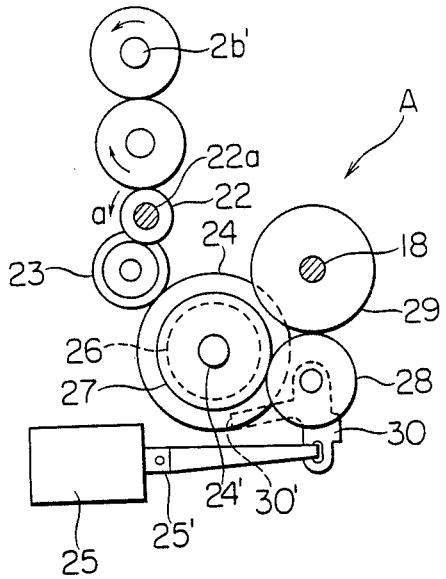
FIG. 11 illustrates gear train A.

The gear train A is provided, as shown in FIGS. 9 and 11, with gear 22 which is rotated in the direction of the arrow mark a by linking with the driving shaft 2b' of the second sheet feed section 2b of the above-mentioned primary sheet feed means 2, gear 23 engaged with the gear 22, gear 24 engaged with the gear 23, and gear 27 coaxially provided to the gear 24 through clutch 26 which is positioned either at engaging or disengaging between them by the working of solenoid 25; and this gear train A is also arranged so as to rotate the friction wheel 19 in the direction of the arrow mark b through an intermediate gear 28 and by way of a gear 29 fixed to one end of shaft 18, in the case that the gear 27 is rotated together with gear 24 by the working of the clutch 26. When the solenoid 25 is in the state of ON, namely, when plunger 25' is pulled into solenoid 25 and the tip 30' of lever 30 is engaged with the ratchets provided to the outer circumference of the clutch 26, the clutch 26 becomes at disengaged position and makes the gear 27 free from the shaft 24, of the gear 24 and, on the other hand, when the solenoid 25 is in the state of OFF. gear 27 is united in a body with shaft 24' of gear 24 due to the clutch 26 becoming at engaging position.

Figure 12I:
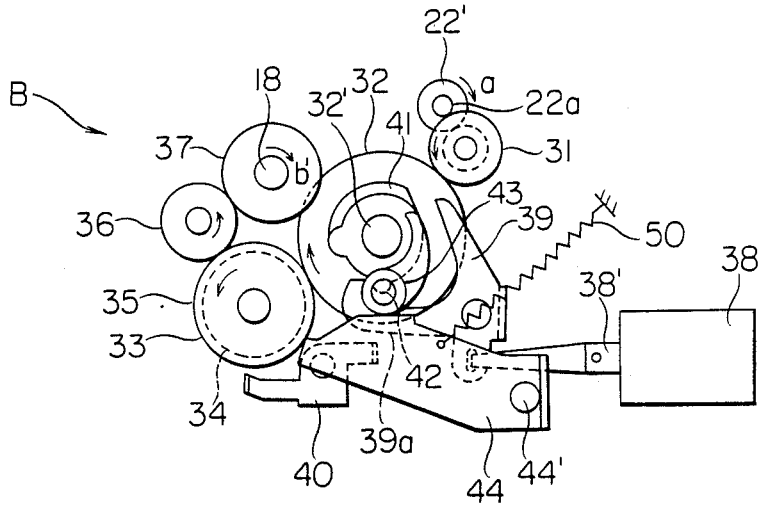
FIGS. 12(I) and 12(II) each illustrate the operation of gear train B.
Figure 12:
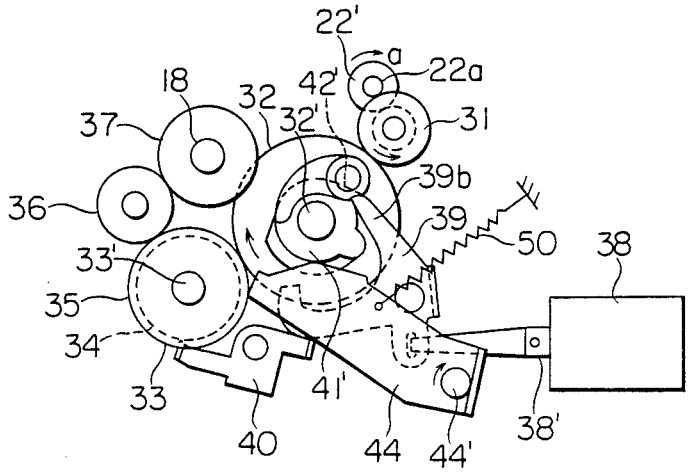

In the meantime, as shown in FIGS. 9 and 12, the above-mentioned gear train B is comprised of gear 31 engaged with gear 22' fixed to the other end of shaft 22a of gear 22 being rotatable in the direction of the arrow a, gear 32 engaged with the gear 31, gear 33 engaged with the gear 32, and gear 35 coaxially provided to the gear 33 through clutch 34 intermittently engaged by the working of solenoid 38 during the gear 35 is rotated together with gear 33 through the working of clutch 34, thereby the friction wheel 19 is rotated in the direction of the arrow b' by way of gear 37 fixed to the other end of shaft 18 through intermediate gear 36.

The above-mentioned clutch 34 operates in such a manner that, when solenoid 38 is switched over to ON and it pulls the plunger 38' so as to rotate forked lever 39 downward against the tension of a spring (not shown) as shown in FIG. 12-II, the tip of lever 40 is lifted up by the working of the forked lever 39 and is the engaged with the ratchet provided to he outer circumference of the clutch 34 so that the clutch 34 makes gear 35 free from shaft 33' of gear 33. And, on the other hand, when the above-mentioned solenoid 38 is switched over to OFF and the above-mentioned forked lever 39 is rotated as shown in FIG. 12-I by the working of the spring (not shown), the above-mentioned clutch 34 operates in such a manner that the above-mentioned lever 40 is disengaged from the ratchet so as to make the above-mentioned gear 35 in a body with the shaft 33' of gear 33. In other words, the above-mentioned friction wheel 19 is rotated in the direction of the arrow b by gear train A, i.e., when solenoid 25 is in OFF state, while it is rotated in the direction of the arrow b' by gear train B, i.e., solenoid 38 is in OFF state. When the friction wheel 19 is rotated in the direction of the arrow b, the solenoid 38 of the gear train B is in ON state so that the gear 35 is made free, and when the rotation thereof is in the direction of the arrow b', the solenoid 25 of the gear train A is in ON state so that the gear 27 is made free, respectively.

Meanwhile, in the case that the forked lever 39 of the gear train B is rotated downward by switching the solenoid 38 over to ON, i.e., when the state shown in FIG. 12-I is switched over to the state shown in FIG. 12-II, the tip of lower lever **39*a* is released from protrusion 42 provided to the outer circumference of built-in roter 41 of the clutch coaxially provided to the above-mentioned gear 32, and the rotor 41 having been inhibited from rotating is started in rotation together with the shaft 32' of gear 32. Accordingly, as shown in FIG. 12-I, rotating lever 44 being so far pressed down by protruded member 43 so provided as to protrude from the outer circumference of rotor 41' is rotated clockwise by the working of spring member 50 and the shaft 44' of the rotating lever 44 is rotated in the same direction. The shaft 44' of the rotating lever 44 is fixedly provided, as shown in FIG. 9, with lifting plate 49 for lifting up copy sheets 3, the lifting plate 49 is so provided at the entrance of stack tray 48 as to be on the same plane with that of the bottom face of the stack tray 48. Therefore, the lifting plate 49 is lifted up to bring copy sheets 3 into pressing contact with the above-mentioned friction wheel 19. The rotor 41 is stopped in motion when it is rotated for a given degree and protrusion 42' provided at approximately the same position with the above-mentioned protrusion 42 is engaged with the hook on the tip of the upper lever 39*b* of the forked lever 39**.

Meanwhile, in the case that the above-mentioned forked lever 39 is rotated upward by the tension of s spring when solenoid 38 is switched over to OFF, the upper lever **39*b* thereof is released from the above-mentioned protrusion 42' of the rotor 41 and the rotor 41 is therefore rotated again together with gear 32, so that, as shown in FIG. 12-I, the rotating lever 44 is pressed down against the tension of spring member 50 and the above-mentioned lifting plate 49 is also lowered down at the same time, by the above-mentioned protruded member 43**.

Figure 13I:
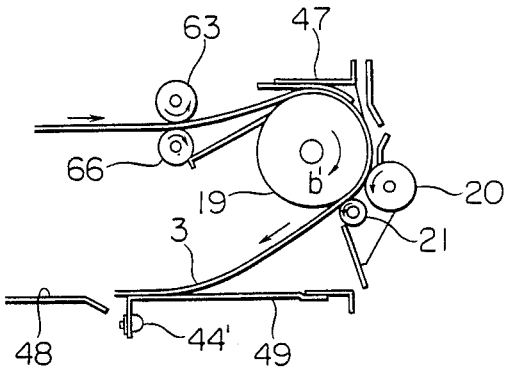
FIGS. 13(I), 13(II) and 13(III) each illustrate the operation of the second conveying part.
Figure 13:
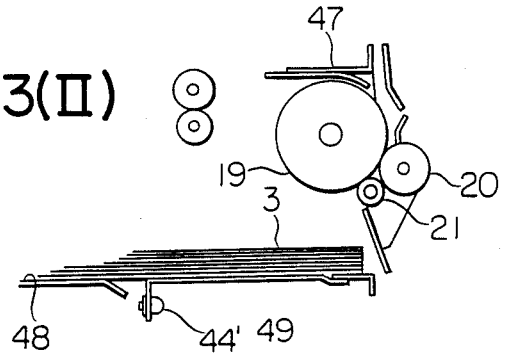

Accordingly, referring now FIG. 13, when copy sheets 3 are sandwiched between feed roller 63 and pressure roller 66 and conveyed thereby through the above-mentioned conveyance path 13 now, the copy sheets 3 is conveyed by friction wheel 19 along guide plate 47 so provided as to cover the copy sheets 3 extendedly from the upper side over to the fore side thereof as shown in FIG. 13-I and is then stored into stack tray 48. because the above-mentioned friction wheel 19 is rotated in the direction of the arrow b' by the working of the gear train B, i.e., in the state where solenoid 38 is switched over to OFF. The constitution around guide plate 47 will be described in detail later. In this instance, the double-feed prevention roller 20 coming into pressing contact with the friction wheel 19 is free from rotation. In addition, an auxiliary roller 21 comes into pressing contact with the lower position of the friction wheel 19 than the contact position for the double-feed prevention roller 20, therefore, the copy sheets 3 are conveyed without fail to the position where the leading edge of the copy sheet 3 hits against stopper member 225 as shown in FIG. 1 provided to the innermost place of stack tray 48. This stopper member 225 is so arranged as to automatically adjust its position to be the copy sheet sizes as will be described in detail later.

Then, as shown in FIG. 13-II, after a given number of one-side copied sheets 3 are stored into the above-mentioned stack tray 48, i.e., after a series of one-side copying operation is completed, the solenoid 38 of the gear train B is switched over to ON and the lifting plate 49 is lifted up as mentioned above, and he uppermost sheet of copy sheet 3 piled on a stack is brought into pressing contact with the lower surface of the friction wheel 19. With a short time lag, solenoid 25 of the gear train A is switched over to OFF and the friction wheel 19 is started in rotation in the direction of the arrow b, that is to say, the friction wheel 19 may not be started in rotation until the copy sheets 3 stored in stack tray 48 are brought into pressing contact with the friction wheel 19. Therefore, the copy sheet 3 is conveyed by the friction of the friction roller 19 and every copy sheet is separated one by one by double-feed prevention roller 20 and is then joined into the first conveying part through the primary sheet feed means 2 from a port 51, and is further fed again into copying section 4.

Figure 14:
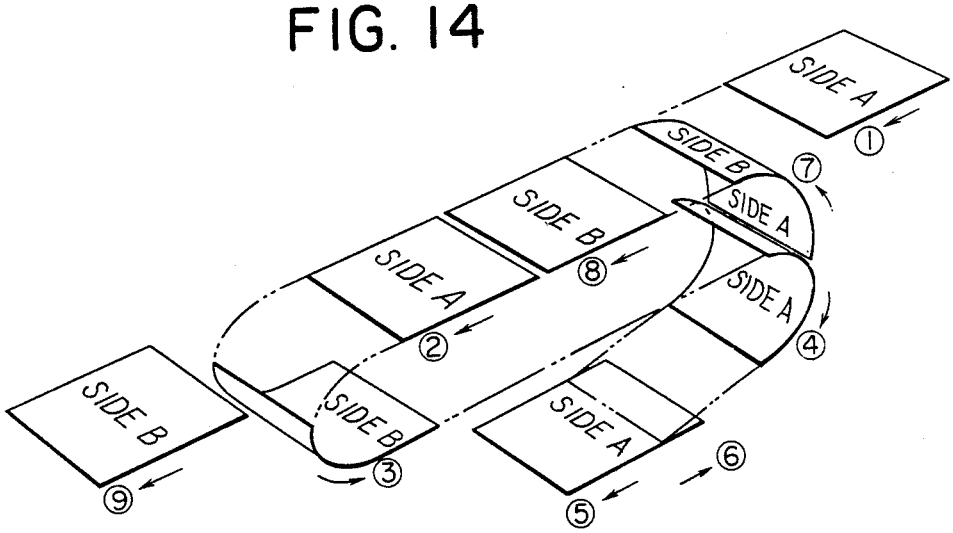
FIG. 14 is an illustration of the feeding, conveying and refeeding process of the copy sheet.

Referring now to FIG. 14, a process, in which copy sheets 3 is fed from primary sheet feed means 2 into copying section 4 and is refed by secondary sheet feed means 17 and thereafter is delivered through the copying section 4, is showed as from Step 1 to Step 9. Namely, Step 1 is in such a state where copy sheets 3 is conveyed from the primary sheet feed means 2 being the side A up; Step 2 is in such a state where copy sheets 3 is one-side copied on the side A in the copying section; Step 3 is in such a state where copy sheets 3 is reversed to be the side B up in the place where movable guide plate 10 is provided; Step 4 is in such a state where by conveyance section 13 of double-side unit 12 copy sheets 3 is directed toward the side of primary sheet feed means 2 being side B up but is so reversed again as to be the side A up by friction wheel 19 of secondary sheet feed means 17; Step 5 is in such a state where copy sheet 3 is stored in stack tray 48; Step 6 is in such a state where copy sheets 3 is fed out from the stack tray 48 by the reversal rotation of the friction wheel 19; Step 7 is in such a state where copy sheets 3 is about to enter into the copy sheet path of the primary sheet feed means 2 and is reversed to be side B up; Step 8 is in such a state where copy sheets 3 is about to be refed into the copying section 4 to be copied on side B; and Step 9 is in such a state where copy sheets 3 is about to be delivered after it was copied on the both side thereof.

In the above-described embodiment of the invention, a friction wheel is exemplified as one of the friction members each capable of rotating in both of the directions of storing copy sheets 3 into a stack tray and feeding them again from the stack tray. It is, however, to be understood that a friction belt may be used without any limitation to this invention.

Figure 15:
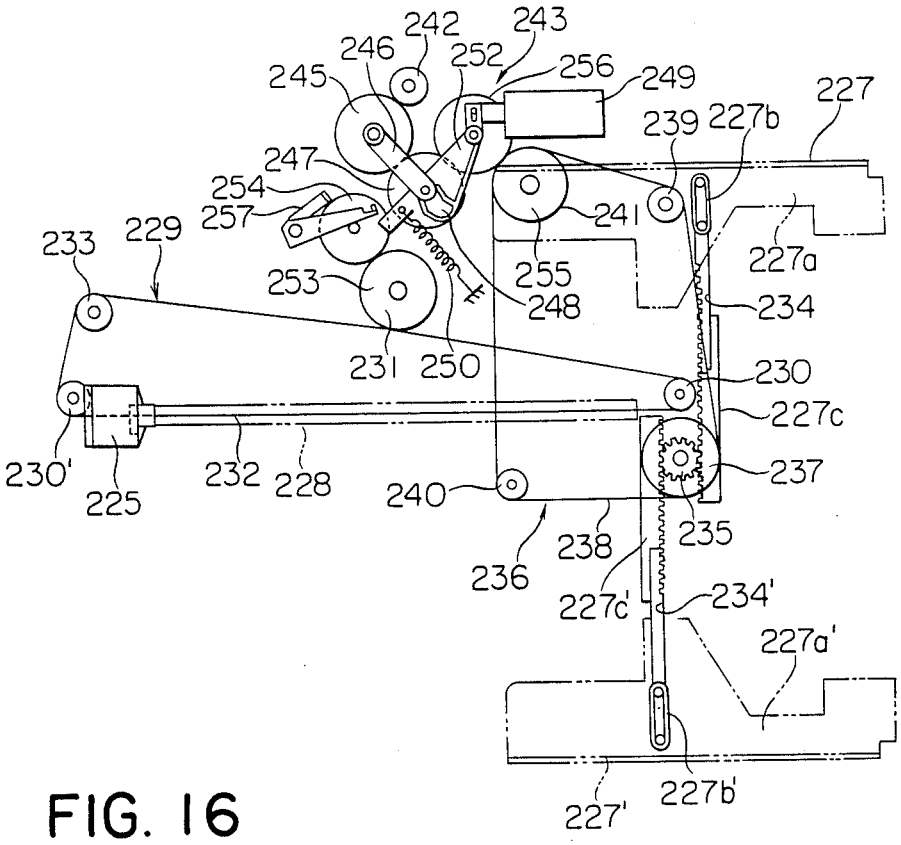
FIG. 15 is a top plain view illustrating the stopper means for stopping the leading edges of the copy sheet, the width regulating plates and the moving mechanism.
Figure 16:
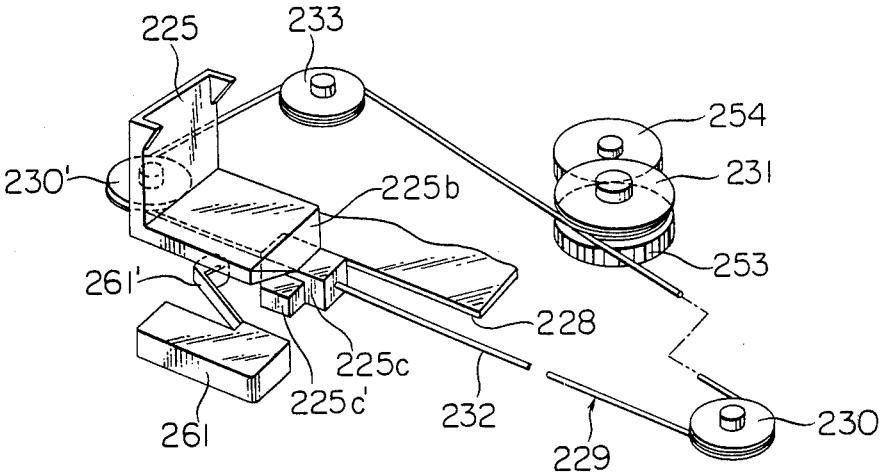
FIG. 16 is a perspective view illustrating the moving means for the leading edge stopper means.

In the above-mentioned embodiment, the stack tray is constituted as follows:

In FIG. 15, the reference numeral 225 designates the aforementioned stopper member for stopping the leading edges of copy sheets provided on the floor board of the above-mentioned stack tray 48; 227 and 227' each are sheet width regulating plates, respectively. The stopper member 225 is L-shaped on the side thereof as shown in FIGS. 15 and 16. The edge of the base board 225*a* forms a slope 225*b*, and underneath the base board 225*a*, there is provided with a protrusion 225*c* inserted in and made slidable along a longitudinal groove 228 provided to the widthwise center line of the floor plate of the stack tray 48. 229 is a moving means for moving the above-mentioned stopper member 225 back and forth along the longitudinal groove 228, and the moving means 229 is so constituted that a length of rope 232 is fastened to the above-mentioned protrusion 225*c* and is stretched between pulleys 230 and 230' each provided to the space underneath the floor so as to correspond to the front and rear ends of the longitudinal groove 228, respectively, and at the same time one end of the rope 232 is wound around driving pulley 231 and the other end thereof is wound around tension-adjusting pulley 233 and is then wound around the above-mentioned driving pulley 231 in reverse winding direction against aforesaid end and the rope ends are wound or rewound around the driving pulley 231 by rotating the pulley 23 regularly or reversely, so that the moving means 229 may be moved back and forth.

Figure 17I:
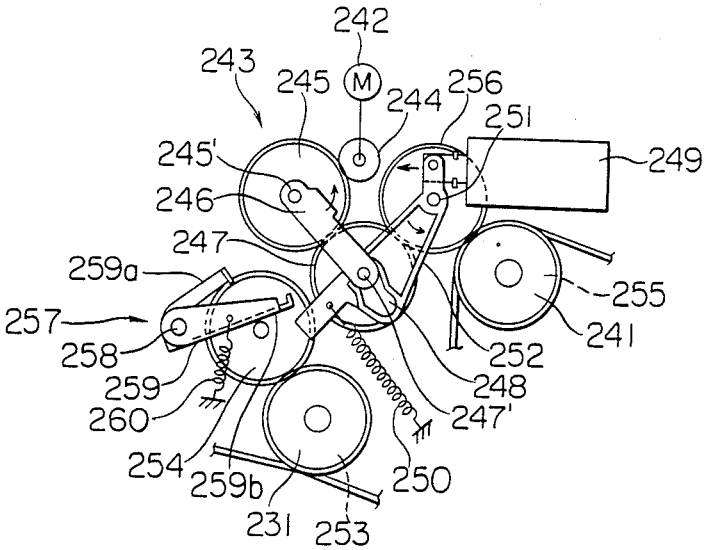
FIGS. 17(I) and 17(II) are the drawings each illustrating the working of the switching means.
Figure 17:
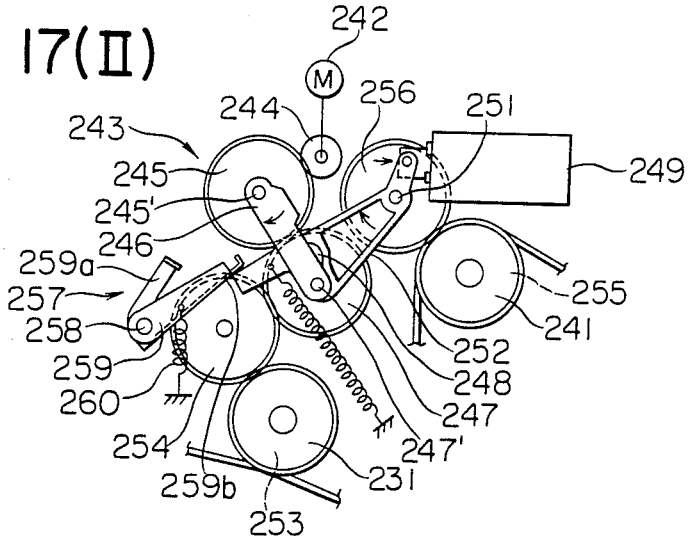
Figure 18:
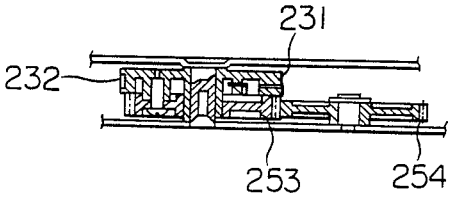
FIG. 18 is a sectional view of the driving pulley.

The sheet width regulating plates 227, 227' are so constructed that a plate material is bent into the L-shape as shown in FIG. 15 and, underneath the horizontal portions 227*a* and 227*a'*, there are provided with protrusions 227*b* and 227*b'* slidably inserted into and along lateral grooves, the bottom surfaces of the protrusions 227*b* and 227*b'* are fixed with racks 227*c* and 227*c'* each arranged on the inner edges thereof with teeth in order, so that a pinion 235 held with a shaft in the space under the floor of the stack tray 48 is interposed between and engaged with the racks 227*c* and 227*c'*. 236 is a moving means for widening and narrowing the sheet width regulating plates 227 and 227' in widthwise. The moving means 236 is so constituted that a length of rope 238 is wound around a pulley 237 coaxially fixed to the pinion 235 and is then led through tension-adjusting pulleys 239 and 240 and the both ends of the rope 238 are so wound around driving pulley 241 as to be opposite to each other, so that the moving means 236 may be moved widthwise through the racks 227*c* and 227*c'* by rotating the driving pulley 241 regularly and reversely and accordingly rotating the pinion 235. 242 is a common driving source for both moving means 229 of the above-mentioned paper leading edge stopper member 225 and moving means 236 of the above-mentioned sheet width regulating plates 227 and 227', and is capable of rotating regularly and reversely either. 243 is a switching means that is, as shown in FIGS. 17-I and 17-II, comprised of a first lever 246 which is capable of swinging about shaft 245' of gear 245 engaged with gear 244 fixed to the output shaft of the above-mentioned driving source 242 and is pivotally supporting driving gear 247 engaging with the gear 245 at the swinging end of this switching means 243 and a second lever 252 which has cam groove 248 inserted with the shaft 247' of the above-mentioned driving gear 247 and is swung about supporting shaft 251 by the workings of solenoid 249 and spring member 250. To be more concrete, when the above-mentioned solenoid 249 is in the state of OFF and the plunger 249' thereof is protruded as shown in FIG. 17-I, the second lever 252 is swung counterclockwise by the working of the above-mentioned spring member 250, the driving gear 247, which is inserted through the shaft 247' thereof into the groove 248 of the second lever 252. is released from gear 254 which is engaged with gear 253 coaxially fixed to the above-mentioned driving pulley 231 as shown in FIG. 18 and is then engaged with gear 256 which is engaged with gear 255 coaxially fixed to the driving pulley 241. On the other hand, when the aforementioned solenoid 249 is switched over to ON and the plunger 249' thereof is pulled as shown in FIG. 17-II, the second lever 252 is swung clockwise against the spring member 250 and, accordingly, the driving gear 247 which is inserted through the shaft 247' thereof into the cam groove 248 is swung together with the first lever 246 as shown by the arrow mark and is then engaged with gear 254 which is engaged with the gear 253 coaxially fixed to the aforementioned driving pulley 231 and is, accordingly, released from the gear 256 which is engaged with the gear 255 coaxially fixed to the driving pulley 241.

The reference numeral 257 designates a locking means for locking the gear 254 engaged with the gear 253 coaxially fixed to the aforementioned driving pulley 231 during the gear 254 is not in operation. In the locking means 257, a ratchet claw is provided to the tip of one end 259*a* of a V-shaped lever 259 capable of rotating about a pin 258 so as to hook a tooth of gear 254 and the other end 259*b* of the V-shaped lever 259 is biased in the direction of engaging the above-mentioned ratchet claw with gear 254 by spring member 260. The other end 259*b* is so extended as to hit against the second lever 252, as shown in FIG. 17-II, during the second lever 252 is swung by the working of solenoid 249 so as to engage driving gear 247 with gear 254. Namely, the above-mentioned locking means 257 is so constituted that, while moving the sheet leading edge stopper member 225, it is released from the gear 254 during the aforementioned driving gear 247 is engaged with the gear 254 engaged with gear 253 coaxially fixed to the driving pulley 231, after moving the sheet leading edge stopper member 225, the gear 254 is locked up during the aforementioned driving gear 247 is made free from the aforementioned gear 254. Thereby, the sheet leading edge stopper member 225 is not moved by the shock caused by copy sheets hitting against the stopper member 225.

The reference numeral 261 as shown in FIG. 16 designates a microswitch capable of detecting the position where the aforementioned stopper member 225 is most advanced to the pulley 230' and of switching the power of the aforementioned driving source 242 over to OFF, and this microswitch 261 is provided with an actuator 261' which collides with the projected portion 225*c'* on the side of the protrusion provided underneath the stopper member 225.

In the aid of this mechanism, during solenoid 249 is in the state of OFF as shown in FIG. 17-I in the normal state of the aforementioned switching means 243, driving gear 247 is engaged with gear 256 further engaged with gear 255 coaxially fixed to driving pulley 241. Therefore, when a copy sheet size is designated by pushing a size-selection button, the rotation of the driving source 242 is started in the given direction and is transmitted to the driving pulley 241 through gears 244, 245, 247, 256 and 255 and thereby one end or the other end of the rope 238 is wound up or rewound. Accordingly, pinion 235 is started in rotation to the right or the left so as to widen or narrow the width between the sheet width regulating plates 227 and 227' according to the copy sheet sizes through the racks 227*c* and 227*c'*. In this instance, it is preferred to preset the criterional position of the sheet width regulating plates 227 and 227' so as to control the positions from the criterional position to the position for a desired sheet size by utilizing pulse signals. When the movements of the sheet width regulating plates are thus completed, solenoid 249 is switched over to ON and driving gear 247 is engaged with gear 254 which is engaged with gear 253 coaxially fixed to driving pulley 231 so as to transmit the rotation of the aforementioned driving source 242 to driving pulley 231 through gears 244, 245, 247, 254 and 253 and resultantly to wind up or rewind one end or the other end of the rope 232. Thereby, the sheet leading edge stopper member 225 is moved back or forth in accordance with the sizes of copy sheets.

Such copy sheets to be stored into stack tray 48 by the aid of this mechanism are orderly set in position by the sheet width regulating plates and the sheet leading edge stopper member each moved to the position corresponding to the sizes of the copy sheets as described above. In this case, the sheet leading edge stopper member 225 is never moved by the shocks of the copy sheets hitting against the stopper member 225, because gear 254 engaged with gear 253 coaxially fixed to driving pulley 231 is locked up during it is not in operation.

Figure 19:
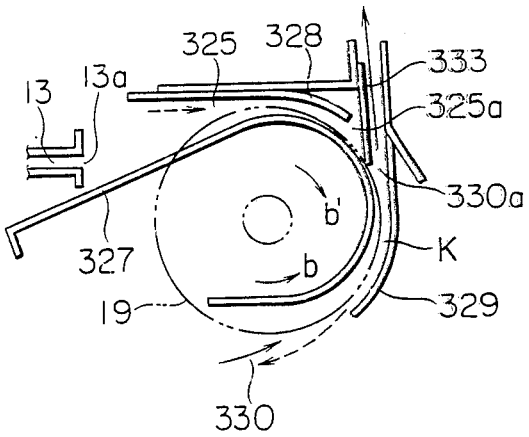
FIG. 19 is a sectional view of the friction roller and illustrates the operation of the elastic thin plate.

Further, in this embodiment, the conveyance path from the secondary sheet feed means to the primary sheet feed means is constituted as follows:

In FIG. 19, the reference numeral 325 designates a path (indicated by the arrow mark of a broken line) for storing copy sheets into a stack tray 48, through which the copy sheets 3 conveyed through the aforementioned Conveyance path 13 and sandwiched between conveyance roller 63 and roller 66 being brought into pressing contact with the conveyance roller 63 are conveyed by the aforementioned friction wheel 19 rotating in the direction of the arrow mark b'. This copy sheet storing path 325 is comprised of an inner side guide plate 327 which is extended from the underneath of the sheet exit 13*a* of the conveyance path 13 and is then curved with a slightly shorter radius, an upper side guide plate 328 which covers along the outer circumference of the friction wheel 19 from the topside and a front guide plate 329 provided outside to the front surface of the friction wheel 19 and in the direction of the tangent line.

The reference numeral 330 designates a sheet refeed path (indicated by the arrow mark of a solid line) for refeeding copy sheets 3 into copying section 4 after a given number of one-side copied sheets were stored into the aforementioned stack tray 48 and were then fed out therefrom by the rotation of the friction wheel 19 in the direction of the arrow b and the lifting motion of the lifting plate 49. This sheet refeed path 330 and the sheet storing path 325 are used as common path in the K section shown in FIG. 19. There is provided to a place adjacent to the entrance 325*a* and exit 330*a* of the common path K with an elastic thin plate, as a preferred embodiment of a communication change means. 333 made of mylar or the like which is capable of opening when an incoming copy sheet is passing through and of returning its original position when the sheet passed therethrough. The basal end of this elastic thin plate 333 is fixed to the inner wall side of the exit 330*a* of the common path K and the free end thereof is so extended as to come into lightly contact with the above-mentioned friction wheel 19.

A copy sheet 3 is conveyed through the aforementioned conveyance path 13 and sandwiched between the conveyance roller 63 and the roller 66 coming into pressing contact with the conveyance roller 63 and is then fed out from the exit 13*a* of the conveyance path 13. Such a copy sheet 3 passes through the storing path 325 and pushes open the elastic thin plate 333 provided to the entrance 325 of the common path K to pass therethrough and is then stored into the stack tray 48 by the aid of the conveyance force of the friction wheel 19 rotating in the direction of the arrow b', as shown in FIG. 13-I. The elastic thin plate 333 returns to its original position when the copy sheet 3 has passed through, as shown in FIG. 13-II.

After a given number of one-side copied sheets are stored into the aforementioned stack tray 48 as shown in FIG. 13-II. and the copy sheet lifting plate 49 is lifted up as shown in FIG. 13-III so as to bring the uppermost sheet of the copy sheets 3 into pressing contact with the friction wheel 19 and at the same time the friction wheel 19 is started to rotate in the direction of the arrow b. At this time, the copy sheet 3 is fed by the friction force of the friction wheel 19 from the stack tray 48 into the exit 330*a* of the common path K through the refeed path 330 and is merged into the copy sheet path of the primary sheet feed means 2, so that the copy sheet 3 may be refed into the copying section 4. In this case, there is no danger at all of any backward flow of copy sheets 3, because the elastic thin plate 333 closes the entrance 325*a* of the common path K as described above.

Figure 20:
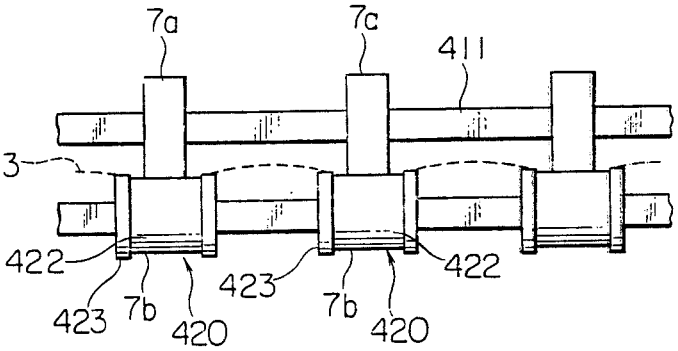
FIG. 20 illustrates a front view of the flange roller.
Figure 21:
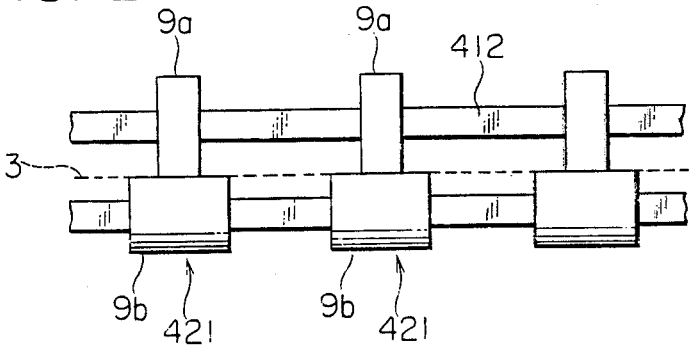
FIG. 21 illustrates a front view of the flat roller.

In this embodiment, the sheet feed roller which is to be used after copy sheets are fixed and the sheet delivery roller provided to the sheet delivery path are constituted respectively as follows:

In FIGS. 1, 20 and 21, out of the aforementioned sheet delivery rollers 7*a* and 7*b*, the lower rollers 7*b* is comprised of flanged rollers 420 provided with a given interval to a shaft as shown in FIG. 20 so that copy sheets 3 may be delivered in such a waveform as indicated by the broken lines by the flanges thereof and the upper rollers each coming into pressing contact with the approximate centers of the flanged rollers 420, respectively. On the other hand, out of the upper and lower sheet feed rollers 9*a* and 9*b*, the lower sheet feed rollers 9*b* is comprised of flat-faced rollers provided with a given interval to a shaft as shown in FIG. 21 so that copy sheets 3 may be fed out flatly as indicated by the broken lines by the upper rollers coming into pressing contact with the approximate centers of the flat-faced rollers 421, respectively.

Figure 22:
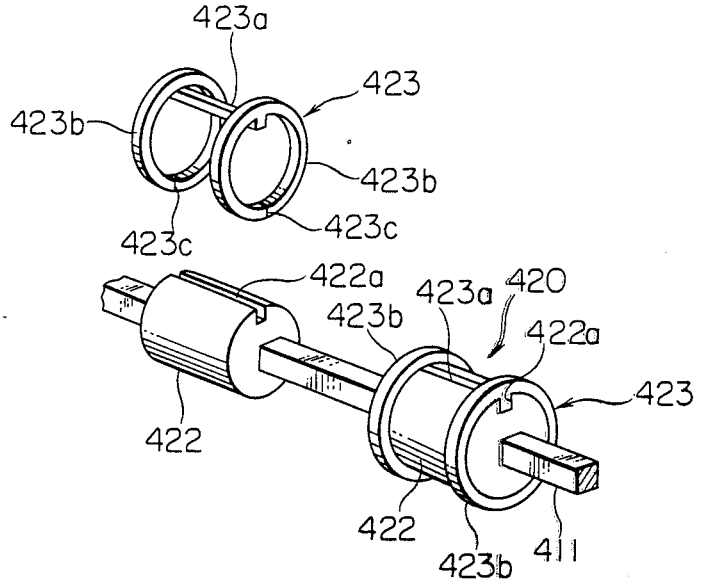
FIGS. 22 and 23 are perspective views which indicates preferred embodiments of the flanged roller.
Figure 23:
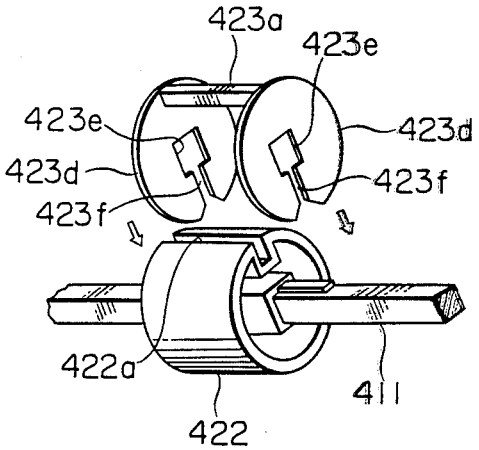

The above-mentioned flanged rollers 420 each are comprised, as shown in FIG. 22, of the roller bodies 422 and the flange members 423 each detachably connected to the both ends of the roller bodies 422, respectively. Every roller body 422 is provided with a concave groove 422*a* along the direction of the roller shaft in at least one position on the circumference of the roller; and the above-mentioned flanged member 423 is comprised of a pair of ring-shaped members 423*b*, 423*b* each having the inner diameter corresponded to the outer diameter of the roller body 422 and a cut in a spot of each of the rings, and the ring-shaped members are provided respectively to the both ends of a bar 423*a* capable of inserting into the concave groove 422*a* of the roller body 422. Meanwhile, the flanged rollers 420 may also be comprised of a pair of disk-shaped members 423*d*, 423*d* each having a larger outer diameter than that of the roller body 422 and the disk-shaped members are provided respectively to the both ends of the bar 423*a* capable of inserting into the concave groove 422*a* of the roller body 422. The disk-shaped members 423*d*, 423*d* each are provided, in the centers thereof, with fitting holes 423*e* to which the shaft 411 of the roller body 422 may be fit in, and the cut 423*f* connecting to the fitting hole 423*e* is so necessary as to fit the shaft 411 therein.

The above-mentioned flat-faced roller 421 is comprised of a roller body 422 only which the flanged member 423 is removed from the flanged roller 420, and the concave groove 422*a* on the roller body 422 may be plugged with an appropriate material, but there is no trouble even if it remains as it is.

When a copy sheet 3 fixed through fixing rollers 6*a* and 6*b* squeezes through between the upper and lower sheet feed rollers 9*a* and 9*b*, there uses a flat-faced roller 421 that is a roller body 422 from which a flange member 423 is removed. Therefore, the copy sheet 3 is naturally curved so as to be flown along the movable guide plate 10.

There also uses a flanged roller 420 which is made by connecting a flange member 423 with a roller body 422 to serve as the lower roller of the sheet delivery rollers 7*a* and 7*b*. therefore, copy sheets may be formed wavewise and made stiff and are delivered to a tray outside the machine while the leading edge of the copy sheet is being kept in a horizontal position.

According to this invention, as described above, in the case that a both-side copying operation is carried out, a mechanism for conveying one-side copied sheets and storing them intermediately into stack tray is made in common use with a mechanism for feeding them out to be copied on their back surfaces and, at the same time, a path for storing them into a stack tray is also made in common use with a path for refeeding them into a copying section, and the portion adjacent to the above-mentioned common path is provided with an elastic thin plate capable of opening the storing path when a copy sheet passes therethrough and returning itself to the original position after the copy sheet passed therethrough. By the aid of the above-mentioned arrangements, the entrance and exit path both connected to same portion of the common path for the sheet storing path and sheet refeeding path may automatically be branched away from each other only by the elasticity of the elastic thin plate and it is not necessary to enlarge the installation space for the both paths as well as to make the constitution complicated, as compared with the case of the conventional type both-side copying machines, so that copying machines may be miniaturized in size ad simplified in operation.

The primary sheet feed means for feeding copy sheets into the copying section is power-linked with the secondary sheet feed means for carrying out the one-side copied sheets from the stack tray to refeed them into the copying section. It is, therefore, possible to adjust the sheet feeding speeds readily between the primary and secondary sheet feed means and to uniform each copy quality on one sides and the other sides of copied sheets and, further, to miniaturize the machines in size and to reduce the costs thereof, different from the conventional type machines provided, respectively, with the independent driving power sources each for their primary and secondary sheet feed means.

Further, a copy sheet leading edge stopper member and sheet width regulating plates are provided onto the floor board of a stack tray for storing one-side copied sheets and the both moving means for the leading edge stopper member and the sheet width regulating plates are linked with a common driving power source through a switching means. It is, therefore, copying machines may also be miniaturized in size and simplified in operation, different from the conventional type machines using the independent driving power sources respectively for moving the leading edge stopper member and the sheet width regulating plates.

A locking means for locking up a driving gear for moving the above-mentioned leading edge stopper member during the driving gear is not in operation. It is, therefore, possible to prevent the stopper member from moving during copy sheets hit against the stopper member and, accordingly, to set the copy sheets orderly without fail and, further to refeed them readily.

Also in this invention, there is provided with a roller capable of making such copy sheets into a waveform in and through the conveyance path. It is, therefore, possible to remedy the curling peculiarity of copy sheets and to improve the sheet passability in and through a conveyance path, the sheet feedability in the course of sheet refeeding and the sheet separability in the course of recopying operations, respectively, because the copy sheets are made into a waveform in and through the conveyance path even if one-side copied sheets should have been curled by heating them in copying and fixing processes.

The above-mentioned sheet conveyance roller is comprised of a roller body and a flange member capable of freely attaching to and detaching from the both ends of the roller body. It is, therefore possible to unite the two parts, i.e., the roller body and flange member, into one roller and to form a flat-faced roller when removing the flange member therefrom, so that there is no need to replace any roller when an ordinary type copying machine is to be added with a double-side copying function.

In an double-side copying machine relating to the invention, there are provided with a friction wheel capable of rotating in the direction of storing one-side copied sheets into a stack tray and in the direction of refeeding them from the stack tray into a copying section, a double-feed prevention roller capable of freely rotating when the friction wheel rotates in the direction of storing the copy sheets and incapable of rotating when the friction wheel rotates in the direction of refeeding them in which the double-feed prevention roller is brought into pressing contact with the friction wheel and, further, an auxiliary roller which is pivotally provided to a lever rotatably extended from the shaft of the double-feed prevention roller and is brought into pressing contact with the friction roller from the underneath of the friction wheel at the lower position than the contact position of the double-feed position roller. It is, therefore, possible to feed incoming copy sheets into the stack tray properly, to set the trailing edges of the copy sheets (i.e., the leading edges thereof in refeeding operation) orderly, to squeeze the copy sheets, and further to prevent double-feed operation by the friction wheel without fail.

Further in the invention, there is provided with a lifting plate for lifting up copy sheets so as to bring them into contact with the friction member, so that the above-mentioned friction member can be started in motion after the copy sheet is brought into contact therewith by the sheet lifting operation of the lifting plate; therefore, the friction member cannot be started in motion unless the copy sheet is brought into contact properly therewith when the copy sheet is fed again from the stack tray. It is, therefore, possible to feed copy sheets without 'sheet damage', even if the copy sheets, such as one-side copied sheets, are lacking in flatness more seriously than in the state of uncopied blank sheets.

In the both-side copying machines relating to the invention, there are provided immediately behind a fixing unit with a movable guide plate capable of switching a sheet delivery path and a sheet returning path over to each other so as to hit the movable end of the movable guide plate against a part of the fixing unit provided to a position upper than the sheet delivery path. It is, therefore, possible to install the copying machine without projecting the movable guide plate from the machine body, different from the cases of the conventional type machines, so that the whole machines may be miniaturized in size.

The above-mentioned movable guide plate is so provided as to be drawn out together with the sheet delivery unit into the direction of delivering the sheets. Therefore, even if any jamming trouble should occur in a portion of the path-change mechanism or sheet fixing section, the above-mentioned troubles can readily be remedied without fail, because the portions necessary to be remedied can widely be opened by drawing out the sheet reversing mechanism.

In addition, the fixing unit is so constructed as not to be drawn out unless the sheet delivery unit loaded with the movable guide plate is drawn out to the direction of delivering copy sheets. It is, therefore, possible to prevent in advance any accident such as that a part of the movable guide plate is deformed or damaged by carelessly drawing out the fixing unit, even when the movable guide plate goes extendedly to the neighborhood of the fixing roller of the fixing unit.

In this invention, there are separably arranged to the bottom side of a copying machine body with a sheet conveyance unit provided with a conveyance path for reversing and conveying one-side copied sheets, a sheet storing unit provided with a sheet stack tray for storing copy sheets therein, and a secondary sheet feed unit provided with a friction wheel capable of rotating in the direction of feeding the copy sheets into the stack tray and in the direction of feeding out the copy sheets from the stack tray; to be more concrete, there are provided with the first unit so constructed as to fix the sheet conveyance unit to the bottom side of the copying machine body, the second unit so constructed as to incorporate a sheet storing unit and a secondary sheet feed unit thereinto, wherein the second unit is connected to the first unit by a hinge, and there are further provided with a spring member for keeping the second unit in the opened position and a locking member for keeping it in the closed position. It is, therefore, possible to attach each of the above-mentioned units compactly and readily to the bottom side of the copying machine body and, it is, accordingly, possible to miniaturize the whole machine body, as compared with the conventional type copying machines having directly incorporated a sheet conveyance path, stack tray and secondary sheet feed means into the machine body thereof or those having attached them into the pedestal of the machine body.

Still further, the second unit can be opened about the hinge member, so that such an excellent advantage can be enjoyed as that such a working as a remedy of a sheet jamming trouble may readily be performed.

What is claimed is:

1. A sheet conveyance apparatus for copying an image on both sides of a sheet comprising:

an image copy means for copying and fixing image information to a sheet;

a delivery means for delivering the copied sheet;

a first conveying part for feeding the sheet to said image copying means and then conveying the copied sheet to said delivery means;

a path-change means arranged in said first conveying part between said image copy means and said delivery means for changing a conveying direction of the copied sheet according to copy pattern orders, said copy pattern orders consisting of an order to copy one side and both sides;

an intermediate tray for storing the sheet copied on one side, before said sheet is refed through the first conveying part in accordance with a both side copy order;

a second conveying part, capable of effecting reversible rotation therein, for storing operation, said conveying part alternately conveying the sheet copied on one side from said path-change means to said intermediate tray in one direction of rotation and for a refeeding operation that feeds the sheet copied on one side from said intermediate tray to said image copy means by reverse direction of rotation; so that the sheet copied on one side can receive image information on the reverse side thereof and then be conveyed to said delivery means; and a double feed prevention roller in presence contact with a reversible roller of said second conveying part, thereby causing a rotation of said double feed prevention roller with said reversible rotation of said reversible roller.

2. The apparatus of claim 1, wherein a lifting plate for regulating a position of said sheet stored in said intermediate tray is further provided between said reversible roller and said intermediate tray, is linked with a reversing mechanism and is operated interlockingly with said reversible roller, so that, when said sheet is fed from said intermediate tray, said lifting plate lifts up said sheet so as to control said reversible roller, thereafter said reversible roller starts said referring operation.

3. A sheet conveyance apparatus for use in a copying apparatus having an image fixing unit and being capable of copying an image on one side of a sheet in response to one side copy order or copying an image on two sides of said sheet in response to a two side copy order said apparatus comprising:

feed tray for storing said sheet;

a first conveying part for feeding said sheet to an image copy part and for delivering the copied sheet to a delivery part;

a path-change means disposed in said first conveying part for changing a conveying direction of a sheet copied on one side to an intermediate tray in response to a two side copy order;

said intermediate tray capable of storing a plurality of said sheets copied on one side;

a second conveying part having a reversible roller capable of conveying the sheet copied on one side into said intermediate tray in a first direction of rotation thereof and refeeding said sheet copied on one side from said intermediate tray to the image copy part in a second direction of rotation;

a double feed prevention roller in pressure contact at a pressure contact position with said reversible roller, thereby causing a rotation of said double feed prevention roller in said first direction of rotation and second direction of rotation of said reversible roller; and a rotation stop means for stopping the rotation of said double feed prevention roller in said second direction of rotation of said reversible roller and for allowing the rotation of said double feed prevention roller in said first direction of rotation of said reversible roller; so that the sheet copied on one side is conveyed into said intermediate tray through said pressure contact portion wherein said double feed prevention roller is rotated by said reversible roller rotating in the direction of said first rotation, and the sheet copied on one side stored in said intermediate tray is refed through said pressure contact portion when the rotation of said double feed prevention roller is stopped by said rotation stop means to prevent more than one sheet of the sheet copied on one side from being refed simultaneously.

4. The apparatus of claim 3, wherein said intermediate tray communicates with a common path at one side thereof, said second conveying part conveys said sheet for storing into and feeds it from said intermediate tray through said common path.

5. The apparatus of claim 4, wherein said common path communicates at one side thereof with both a storing path communicating with said path-change means, and a feeding path communicating with said image copy means and at the other side thereof with said intermediate tray, wherein there is provided a communication change means at the side of said common path communicating with both said storing path and said feeding path, so that, while said sheet is conveyed from said storing path to said common path, said communication-change means prevents said sheet from proceeding to said feeding path, and while said sheet is fed from said common path to said feeding path, said communication-change means prevents said sheet from proceeding to said storing path.

6. The apparatus of claim 5, wherein said communication-change means comprises an elastic plate member arranged between said storing path and said feeding path.

7. The apparatus of claim 6, wherein said elastic plate member is MYLAR.

8. The apparatus of claim 5, wherein said second conveying part is linked with said first conveying parts so that both conveying parts can be driven by a common driving source, wherein said first conveying part comprises a first feed means disposed between said feed tray and said image copy means and said second conveying part comprises a second feed means disposed at said common path.

9. The apparatus of claim 8, wherein said second conveying part comprises a conveyance unit that conveys the sheet from said path-change means to said common path, a sheet feed unit that includes said second feed means and a sheet storing unit that includes a stack tray, wherein said conveyance unit, said sheet feed unit and said sheet storing unit are so constructed as to be separated respectively from each other.

10. The apparatus of claim 9, wherein said conveyance unit, said sheet feed unit and said sheet storing unit are incorporated underneath said first conveying part in a copying machine.

11. The apparatus of claim 10 wherein a first unit comprises said conveyance unit and a second unit comprises said sheet storing unit and said sheet feed unit, said first unit being fixed underneath sad first conveying part and said second unit being attached underneath said first unit by a hinge member whereby said second unit can be opened in a downward direction, said apparatus further comprising a spring member connecting said first unit and said second unit whereby said second unit can be maintained in an opened position; and wherein there is further provided a locking member for locking said second unit in a closed position, said locking member being released when said second unit is opened.

12. The apparatus of claim 3, wherein said first conveying part comprises a sheet delivery unit for delivering said conveyed sheet from and image fixing unit to said delivery part, wherein said path-change means comprises a movable guide plate disposed between said fixing unit and a sheet delivery unit, wherein an upper end of said movable guide plate contacts the upper portion of the conveying path of said fixing unit.

13. The apparatus of claim 12, wherein said upper portion is positioned at an inner side of said fixing unit.

14. The apparatus of claim 12, wherein the lower end of said movable guide plate is extended to the lower portion of said fixing unit and is rotatably supported by the lower portion of said sheet delivery unit, said movable guide plate thereby being rotated around said lower end thereof.

15. The apparatus of claim 14, wherein said upper portion of said movable guide plate is bent to be concave on the side of said fixing unit.

16. The apparatus of claim 15, wherein said movable guide plate is so constructed as to be taken out together with said sheet delivery unit in the sheet delivering direction.

17. The apparatus of claim 16 wherein said fixing unit can be removed transversely to the sheet conveying direction and said sheet delivery unit has a locking member for preventing the removal of said fixing unit, wherein said locking member is released when removal of said fixing unit is desired.

18. The apparatus of claim 3, wherein said first conveying part and said second conveying part comprise a plurality of conveying roller means including a smooth roller means the external round surface is smooth and a flange roller means which has a round flange member capable of being attached to and being detached from said smooth roller means.

19. The apparatus of claim 18, wherein said smooth roller means is a cylindrical roller and has a groove on the circumference thereof in the axial direction, said round flange member comprising a disk-shaped member which has a hole at the center portion thereof to fit a shaft of said smooth roller which has a guide-way from the circumference of said disk member to said hole to guide said shaft to said hole, the diameter of said disk-shaped member being larger than the outside diameter of said smooth roller means, there being a pair of said disk-shaped members connected at both ends of a bar, said bar being so shaped in respect to said groove that said disk-shaped members can be attached to said smooth roller means by inserting said bar into said groove.

20. The apparatus of claim 18 wherein said smooth roller means comprises a cylindrical roller having a groove on the circumference thereof in an axial direction, said round flange member being a ring-shaped member having a cutway through one portion thereof, wherein a shaft of said smooth roller passes through the center of said ring-shaped member, in an axial direction, the inside diameter of said ring-shaped member corresponding to the outside diameter of said smooth roller means, a pair of said ring-shaped members being connected to each end of a bar, wherein said bar is shaped to correspond to the shape of said groove, said ring-shaped members being attached to said smooth roller means by inserting said bar into said groove.

21. The apparatus of claim 3 wherein there is provided an intermediate tray stop member and a width regulating member on said intermediate tray, said intermediate tray stop member moving in a conveying direction of said sheet and said width regulating member moving transversely to said conveying direction, whereby both said intermediate tray stop member and said width regulating member move corresponding to a sheet size to regulate the edges of said sheet; and wherein both said intermediate tray stop member and said width regulating member are driven by a common driving source through respective moving means and a switching mechanism.

22. The apparatus of claim 21 wherein said moving means for said intermediate tray stop member has a locking member for preventing said intermediate tray stop member from moving when said moving means for said intermediate tray stop member is not in operation.

* * * * *